US005899535A

United States Patent [19]

LeBlond

[11] Patent Number: 5,899,535

[45] Date of Patent: May 4, 1999

[54] SELF-POWERED PORTABLE ROCK CRUSHER

[75] Inventor: Joseph Michel LeBlond, Edmunston, Canada

[73] Assignee: F.A.H.R. Industries Inc., Edmundston, Canada

[21] Appl. No.: 08/874,199

[22] Filed: May 30, 1997

Related U.S. Application Data

[63] Continuation-in-part of application No. 08/747,839, Oct. 15, 1996, Pat. No. 5,695,255, which is a continuation of application No. 08/421,915, Apr. 13, 1995, abandoned.

[51] Int. Cl.[6] ..... E01C 19/05; B02C 13/28

[52] U.S. Cl. ..... 299/39.8; 299/108; 172/540; 172/554; 241/191

[58] Field of Search ..... 37/189; 172/108, 172/119, 518, 532, 540, 550, 554; 299/39.4, 39.8, 87.1, 108; 241/189.1, 191

[56] References Cited

U.S. PATENT DOCUMENTS

| | | | |
|---|---|---|---|
| 4,373,678 | 2/1983 | Reitter | 241/189.1 |
| 5,259,692 | 11/1993 | Beller et al. | 299/39.4 X |
| 5,320,292 | 6/1994 | Smith | 241/191 |
| 5,647,641 | 7/1997 | Sulosky et al. | 299/39.8 |
| 5,695,255 | 12/1997 | LeBlond | 299/39.4 X |

*Primary Examiner*—James A. Lisehora
*Attorney, Agent, or Firm*—McFadden, Fincham

[57] ABSTRACT

There is disclosed a rock crushing apparatus having a frame, an anvil mounted therein and a mounting for a rotor. The rotor has hammer elements disposed thereon for cooperation with the anvil. The rotor includes an outside surface, a plurality of recesses in spaced relation about the outside surface and a plurality of rotor protection members for protecting the rotor. The rotor protection members are releasably mounted in the recesses and extend outwardly of the outside surface of the rotor means for preventing wear of the outside surface. The hammer elements are releasably mounted in the recesses and in alternation with the rotor protection elements and extend outwardly of the rotor protection members. The hammer elements lift and pulverize the rock material. This arrangement has been found to be more effective than any of the prior art arrangements due to the configuration of the hammer elements and their disposition on the rotor.

18 Claims, 4 Drawing Sheets

SELF-POWERED PORTABLE ROCK CRUSHER

This application is a continuation-in-part of U.S. patent application Ser. No. 08/747,839 filed Oct. 15, 1996, now U.S. Pat. No. 5,695,255, which is a continuation of U.S. patent application Ser. No. 08/421,915 filed Apr. 13, 1995, now abandoned.

FIELD OF THE INVENTION

The present invention is directed to a self-powered portable rock crusher and more particularly to machines which are especially adapted to prepare on-site material for use in constructing, maintaining, reconstructing or reconditioning road surfaces.

BACKGROUND OF THE INVENTION

Ground breaking assemblies and rock processing apparatus have been previously proposed in the prior art to a great extent. Many of the apparatus have been either self propelled, small scale or large scale, or used in combination with some form of a suitable vehicle.

Rafferty et al., in U.S. Pat. No. 2,905,456 issued Sep. 22, 1959, discloses a breaker bar and pulverizer assembly for road rebuilding. The arrangement includes a breaker bar which is configured and disposed to dig into or otherwise excavate the surface of a road. Material that is introduced by the breaker bar is transmitted to a further surface where the material is contacted by a series of pulverizer blades. The blades are essentially elongate articles which break material against an anvil surface associated with the breaker bar. Although the arrangement appear to be useful, it is clear that there are a significant number of moving parts and further, that the arrangement is primarily directed to an excavating arrangement.

In a similar manner, Bellar et al., in U.S. Pat. No. 5,259,692, issued Nov. 9, 1993, discloses a ground excavating arrangement. In the arrangement provided in this reference, the rock material is effectively projected against fracture boards in order to break the same. There is no real pulverization per se and no coaction of a hammer element with an anvil member to pulverize to the point of particulation material. There is a certain degree of co-action of the hammer elements with an anvil, but this action does not appear to be directed to pulverization, but rather simple fracture. Furthermore, the arrangement is designed to excavate a surface as opposed to simply processing existing partially fractured rock material. This arrangement is also limited by the fact that it requires outboard power to drive the arrangement and provides no protection for the rotor against damage.

A further reference in this art is U.S. Pat. No. 4,560,009, issued to Lindbeck, issued Dec. 24, 1985. The reference provides pulverizing apparatus for pulverizing aggregate masses of frangible materials on and below earth surfaces. In the arrangement, a collection bar is provided which digs into the ground surface as the apparatus is dragged therealong. This collection plate coacts with hammer elements to at least partially break the rock material into smaller portions. There does not appear to be pulverization of rock material. Further, the rotor would appear to be fully exposed to potential damage by the rock material contacting the hammer elements.

Other prior art generally related to this subject matter includes the following U.S. Pat. Nos.: 4,417,627, 4,826,352, 5,025,995, 3,850,375, 4,006,936, 4,732,506, 4,704,045, 4,573,826, 4,417,627, 4,637,753, 3,602,444, 4,848,677, 4,785,560, 4,355,670, 2,313,471, 4,704,045, 4,871,213, 4,878,713, 5,854,147 and 3,732,023.

It would be desirable to have a rock processing apparatus which could effectively process more rock material than prior art arrangements and further, which include protective elements for the rotor as well as hammer elements that, even under wear conditions, could still function adequately over long periods of time.

The present invention is directed to satisfying the limitations that have been experienced with prior art arrangements.

SUMMARY OF THE INVENTION

One object of the present invention is to provide an improved rock crushing apparatus.

A further object of the present invention is to provide, in a rock crushing apparatus having a frame, an anvil mounted therein and a means for mounting a rotor means having hammer elements disposed thereon for cooperation with the anvil, the improvement wherein the rotor means has an outside surface; a plurality of recesses in spaced relation about the outside surface; a plurality of rotor protection members for protecting the rotor, the rotor protection members being releasably mounted in the recesses, the rotor protection members extending outwardly of the outside surface of the rotor means for preventing wear of the outside surface; hammer means releasably mounted in the recesses of the rotor means, the hammer means mounted in alternation with the rotor protection means in the recesses and extending outwardly of the rotor protection members, the hammer means for lifting and pulverizing rock material.

The rotor assembly is obviously of critical importance to the efficiency of the rock crushing system. To this end, it has been found that maximum efficacy can be realized by providing an alternating arrangement of hammer elements with secondary wear elements. This achieves numerous functions which include:

1. a lighter weight rotor assembly;
2. an opportunity to vary the disposition of the hammer elements such that a helical pattern is associated with the rotor assembly to thereby increase the efficiency with which the rotor assembly gathers rock material; and
3. a longer lasting rotor body ensues since there are provided wear elements, hammer elements, both of which are replaceable and which radiate outwardly from the surface of the rotor body thus preventing premature wear of the body.

In terms of useful materials of which the hammer elements and secondary elements are composed, satisfactory results have been obtained by making use of the various steel alloys known to be hard wearing. Other suitable hard wearing materials which may be borrowed from the mining art could form the basis of the composition for these elements.

Regarding the hammer elements themselves, the same are generally elongate articles having a generally claveat-shaped profile. It has been found that this profile is particularly useful for gathering and retaining rock material during rotation of the rotor and further, that this configuration is less prone to premature wear. Any suitable configuration of the hammer elements and secondary wear elements may be incorporated on the rotor body. The only deciding factor is that the radial weight distribution is equivalent in order to facilitate balance and smooth rolling. In situations where different rock materials are encountered, it is possible to alternate the number of hammer elements with the secondary elements such that a less or greater number of hammer elements are disposed on the rotor body.

A further object of one embodiment of the present invention is to provide a rock crushing apparatus for crushing rock material, the apparatus having a center of mass, the apparatus, comprising:

a rotor means having hammer elements disposed thereon for cooperation with the anvil, the improvement wherein the rotor means has an outside surface; a plurality of recesses in spaced relation about the outside surface; a plurality of rotor protection members for protecting the rotor, the rotor protection members being releasably mounted in the recesses, the rotor protection members extending outwardly of the outside surface of the rotor means for preventing wear of the outside surface; hammer means releasably mounted in the recesses of the rotor means, the hammer means mounted in alternation with the rotor protection means in the recesses and extending outwardly of the rotor protection members, the hammer means for lifting and pulverizing rock material;

a frame means for rotatably and releasably mounting the rotor means;

a means for connection with a vehicle on the frame means; and, independent drive means on the frame means for driving the rotor means, the drive means positioned forwardly of the center of mass of the apparatus for stabilizing the apparatus when in use.

As is known in this art, significant forces are realized by the rotor body, the hammer elements and the entire apparatus generally. To this end, in use existing rock crushing apparati are often displaced laterally by such forces and further, the entire arrangement is susceptible to bouncing about a vertical axis. In order to obviate this difficulty, it has been found that if the center of mass of the arrangement is altered, bouncing and lateral displacement etc., are substantially alleviated. To this end, the displacement of the drive source, an example of which may be an internal combustion engine, to the forward end of the frame relative to the rotor body achieved desirable results. In this arrangement, the significant mass presented by the drive system is removed from the general location of the rotor and as such, there is a mass to compensate for the bouncing. In this manner, bouncing is substantially reduced since forces experienced by the rotor are effectively counterbalanced by the mass of the engine at the forward end of the apparatus. As a natural consequence, the movement of the mass to the forward end removes the same from being directly over the rotor, which would otherwise damage it by having the bouncing action amplified by the mass of the engine.

The system set forth herein has been designed to work on the surface of the substrate upon which the rock material is positioned. This system does not excavate or otherwise dig into the substrate, but rather operates directly on the surface for maximum efficiency. Part of the attractiveness of this engineering is that the hammer elements are not subject to premature wear from any excavation and therefore are effectively preserved for pulverization of rock material thus adding to their useable lifespan. As will be readily appreciated by those skilled in the art, this arrangement clearly prevents hammer element scuff or drag during rotation and therefore not only adds to the useable lifespan of the hammer elements, but further prevents unnecessary torque being experienced by the transmission and other drive components.

A further object of one embodiment of the present invention is to provide a rock crushing system for crushing rock material, the apparatus including frame means, connection means on the frame means for connecting the frame means to a vehicle;

anvil means associated with the frame means;

a rotor means having hammer elements disposed thereon for cooperation with the anvil means, the rotor means having an outside surface;

a plurality of recesses in spaced relation about the outside surface;

a plurality of rotor protection members for protecting the rotor, the rotor protection members being releasably mounted in the recesses, the rotor protection members extending outwardly of the outside surface of the rotor means for preventing wear of the outside surface;

hammer means releasably mounted in the recesses of the rotor means, the hammer means mounted in alternation with the rotor protection means in the recesses and extending outwardly of the rotor protection members, the hammer means for lifting and pulverizing rock material against the anvil means;

independent drive means on the frame means for driving the rotor means, the drive means positioned forwardly of the center of mass of the apparatus for stabilizing the apparatus when in use; and, a vehicle for advancing the apparatus.

As a further attendant advantage to the arrangement, forward extensions may be provided which are bent inwardly such that the opening therebetween is progressively narrowed. This has the effect of collating the rock material and therefore introducing the material in a more ordered form to the rotor assembly. This is complimentary to the helical arrangement of the hammer elements on the rotor; these two features combine to effectively draw the rock material from the opposed ends of the rotor assembly to the middle portion thereof thus ensuring maximum contact with the hammer elements during this movement and most efficient operation of the arrangement.

Having thus described the invention, reference will now be made to the accompanying drawings illustrating preferred embodiments.

BRIEF DESCRIPTION OF THE DRAWINGS

Similar numerals in the drawings denote similar elements.

DETAILED DESCRIPTION OF THE PREFERRED EMBODIMENTS

Figure 1:
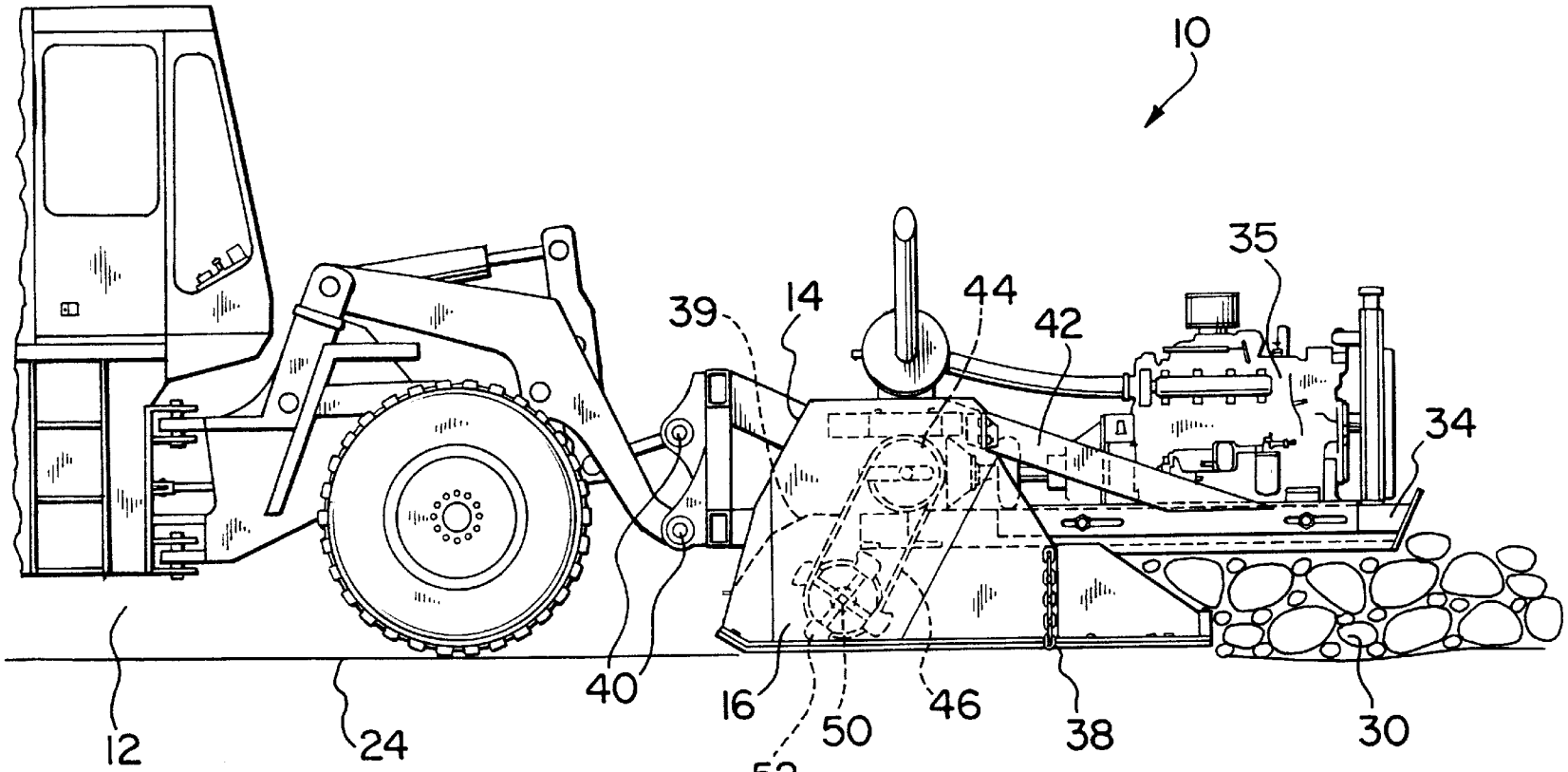
FIG. 1 is a side view of the overall rock crushing system.
Figure 6:
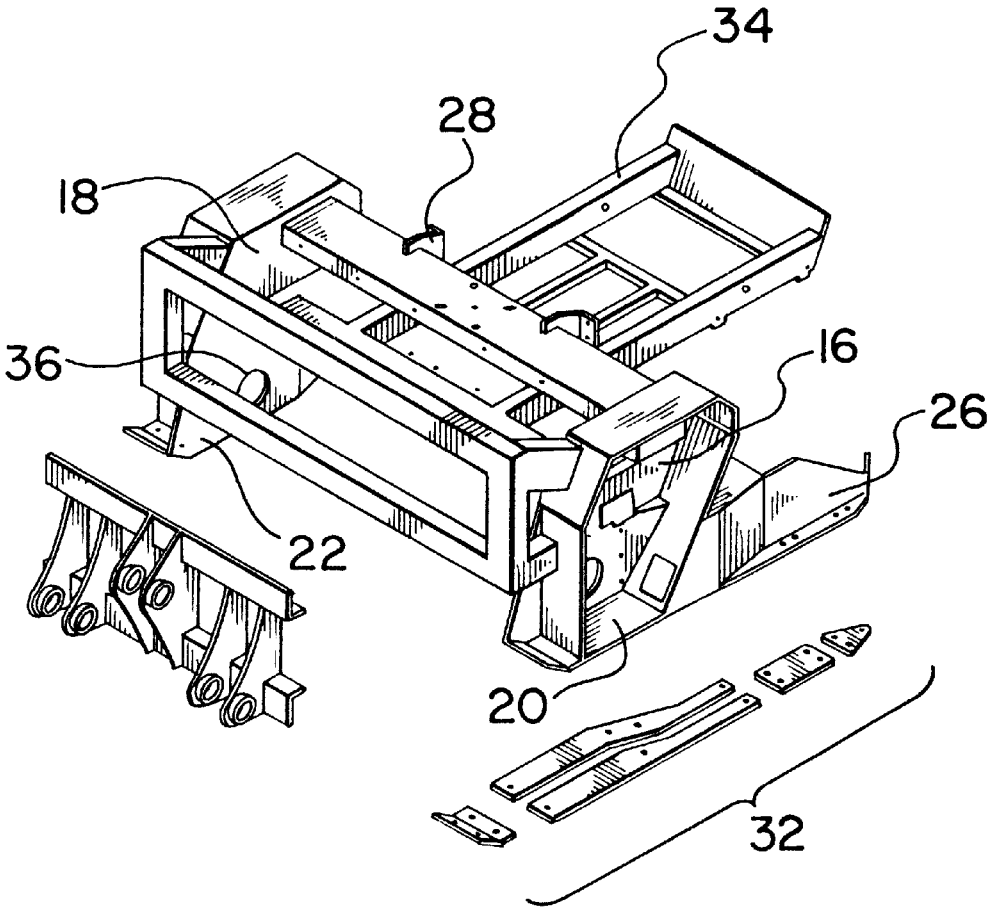
FIG. 6 is a perspective view of the frame.

Referring now to FIG. 1, shown is one embodiment of the rock crushing apparatus, globally denoted by numeral 10 as connected to a vehicle 12. Generally speaking, the apparatus includes a frame 14, shown best in FIG. 6, having spaced apart end walls 16 and 18, each having a lower wall 20 and 22, respectively for direct contact with the ground surface, generally denoted by numeral 24. Each of the walls 18 and 20 includes a forward extension 26 and 28 with each extension directed inwardly toward one another to reduce the overall breadth of the opening between extensions 26 and 28. This has the effect of collating rock material 30 shown in FIG. 1 between the extensions 26 and 28 and therefore into contact with the rotor to be discussed hereinafter. Suitable wear elements, globally denoted by numeral 32, are releasably engageable with the undersurface of each of the base walls 20 and 22 to prevent wear directly thereon during use of the apparatus 10. These elements may comprise any suitable long wearing material, i.e. tungsten carbide, or any suitable hard wearing alloy. The frame 14 provides a forward extension 34 for mounting an internal combustion engine 35 or any other suitable form of power drive. Each end wall 16 and 18 includes an aperture 36, each aperture 36 being in longitudinal registration and for receiving a rotor axle therethrough (to be discussed hereinafter). The frame may also include a chain curtain 38 adjacent the front end of the extensions 26 and 28 extending the width thereof for fragment control during the crushing/pulverizing procedure. A deflector cover 39 for directing material to the ground surface may also be provided. A connection site 40 is provided for connecting the apparatus 10 to a vehicle 12. The connection site 40 will permit suitable manipulation of the apparatus 10. Engine 35 includes the conventional clutch type power take-off 42 which communicates with a power drive pulley 44. The pulley 44 includes a belt 46 which, in turn, drives the rock crushing rotor 50. Rotor 50 includes a plurality of hammer elements 52 which cooperate with anvil 54 and more particularly the wear element 56 associated with anvil 54.

Figure 2:
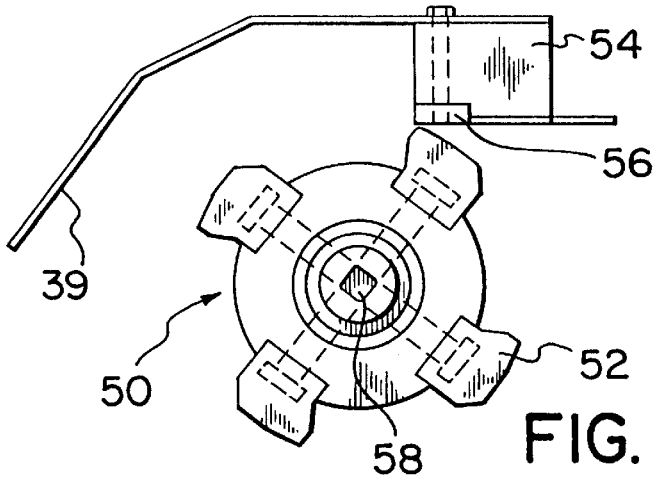
FIG. 2 is a side view with elements removed for clarity illustrating the relationship of the rotor relative to the anvil.
Figure 3:
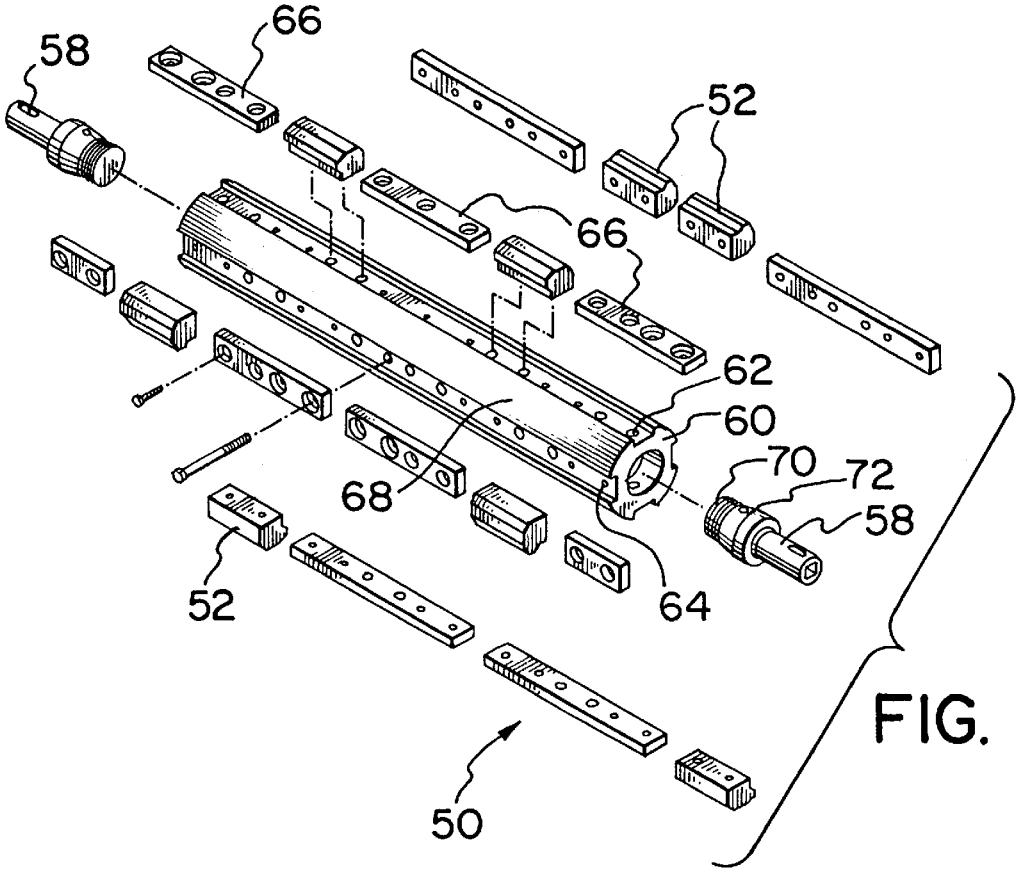
FIG. 3 is an exploded view of the rotor assembly.
Figure 4:
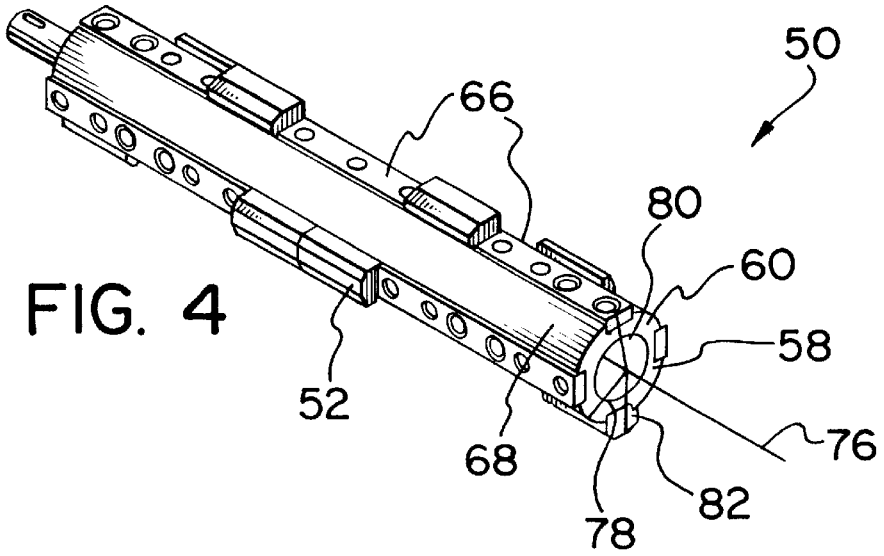
FIG. 4 is a perspective view of an assembled rotor.

Turning to FIGS. 3 and 4, shown in greater detail are the anvil and the rotor as well as the hammer elements. As is illustrated in FIG. 3 rotor 50 includes a longitudinal axis and releasably mounts a plurality of hammer elements 52 to the surface of rotor 50. The hammer elements have a very limited clearance (FIG. 2) with the anvil 54 and more particularly the wear elements 56. The spacing between the hammer elements 52 and the wear elements 56 is such that the rock material is confined to a very limited space and therefore is pulverized from an initial state such as that as shown in FIG. 1 and represented by numeral 30 to a fairly particulated rock material ideally suited to compaction.

Specifically referring to FIG. 3, shown is an exploded view of the rotor 50. As is illustrated, the rotor includes a rotor body 60, composed of, for example, a suitable steel alloy material which includes a plurality of spaced apart recesses 62, each recess including a plurality of threaded apertures 64. The longitudinal recesses 62 extend the full length of the body 60. Within the recesses, the hammer elements 52 are releasably mounted as indicated. In addition to the hammer elements 52 being mounted in the recesses, the same are mounted in alternation with wear plates 66.

The wear plates 66 simply comprise generally rectangular members which may be composed of the same material as hammer elements 52 and serve to not only reduce the overall mass of the rotor assembly 50, but also act as a protection for the recesses 62 in the rotor body 60 as well as for the arcuate segments 68 of the rotor body 62 which are between recessed areas 62.

A particularly useful feature of the present invention is the design of the shafts 58 which are threadably received within the rotor body 60 as shown in FIG. 3. As is illustrated, the shaft each include a threaded segment 70 and co-extensive therewith an outwardly diverging segment 72 which increases in cross-sectional area from the threaded portion 70 to the shaft 58. It has been found that by providing this taper segment 72 that the significant forces encountered by the rotor do not result in the disengagement of the rotor body 60 from shafts 58. In this manner, the shafts are self-retained in the rotor 60. This also advantageously prevents over tightening and/or thread damage to the threads 70.

As illustrated in FIGS. 3 and 4, the assembled rotor assembly 50 includes an alternating pattern of element 66 with elements 52 and further, the disposition of these elements is such that when the assembly 50 is rotated, the helical pattern results. This has been found useful to assist in gathering rock material and directing it from the opposed ends of the rotor 50 to the middle portion thereof.

As is illustrated in FIG. 4, in assembled form, the rotor assembly 50 has a plurality of radii relative to a central axis 76 of the assembly 50. The first radii 78 extends from the central axis to the outside surface 68 of rotor body 60. A second radii 80 extends from central axis 76 to member 66 and radius 80 is greater than radius 78. In this manner, the surface 68 is protected from significant damage by encountering rock material 30 as illustrated in FIG. 1. A third radii 82 extends from axis 76 to the hammer elements 52 with radius 82 being greater than radii 78 and 80. A further advantage to the various radii for the assembly 50 can be realized in that a secondary pulverizing surface is provided with members 66 to compliment members 52. Members 66 also prevent premature wear or damage to surfaces 68 associated with body 60.

Although a pattern for the hammer elements 52 is shown in FIG. 3 and 4, it will be realized that this is only an exemplary embodiment, any disposition of hammer element 52 which is balanced on body 60 would be suitable. To this end, the entire length of the rotor body 60 could include hammer elements 52 if one desired.

Figure 5:
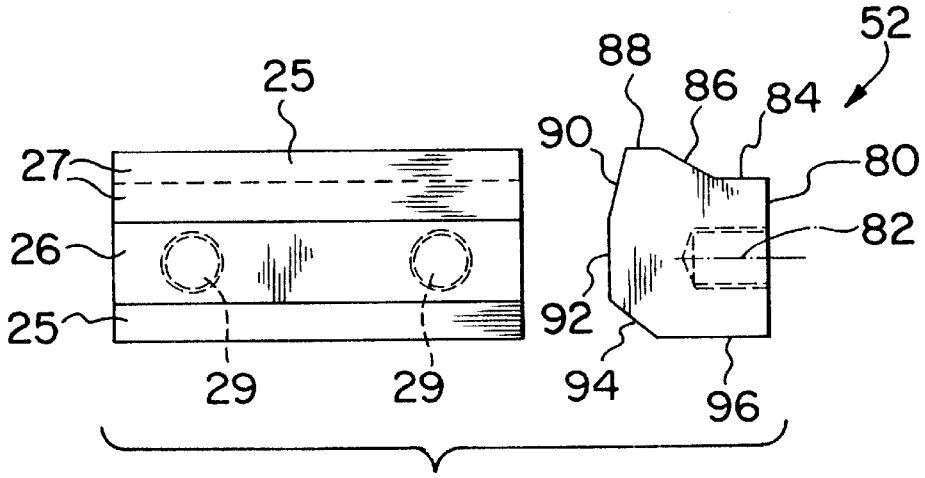
FIG. 5 is an end elevational view of an individual hammer element.

Referring now to FIG. 5 and in greater detail with respect to the hammer elements 52, the hammer elements generally subscribe to a claveat-shape which is instrumental in their function. To this end, the members 52 include a flat mounting surface 80 with a plurality of openings 82 extending through the body to facilitate connection to rotor body 60. To this end, the openings may include threading or any other suitable form for connection to body 60. Each element 52 includes a scooping face comprised of a first perpendicular wall 84 being perpendicular relative to the mounting surface 80 which wall 84 includes an inclined segment 86 and a further slot wall 88. Wall 88 is coplanar with wall 84.

Turning to the pulverizing section of the hammer element 52, wall 88 terminates with a slightly inclined segment 90 which segment then merges with a flat wall segment 92, the latter being parallel to mounting portion 80. Segment 92 terminates in a downwardly inclined segment 94 which is generally coplanar with wall 86 described herein previously. Wall 94 then extends to a further segment 96 which is parallel to wall 84 and of a greater length than 84.

It has been found that this shape of the hammer element is most useful and facilitates the realization of significant advantages. As indicated herein previously, the scoop shape defined by surfaces 84, 86 and 88 is particularly useful to introduce rock material into the area occupied by the rotor assembly 50. Wall elements 90, 92 and 94 cooperate to coact with wear member 56 of anvil 54 to provide a pulverizing action to rock material. In this regard, reference is made to FIG. 2 illustrating the close tolerance between member 56 and wall segments 88 and 90 of element 52. As will be readily appreciated, depending on the nature of the rock material that is to be pulverized, the distance between hammer element 52 and more particularly the surfaces 88, 90, 92 and 94 can be varied by modifying the width of wear elements 56 or extending the same downwardly in position so that the distance between members 56 and wall segments of element 52 is either greater or less than that indicated in FIG. 2.

The function of elements 52 is also retained during wearing of the elements. This is due to the shape (scoop) which still provides utility even when partly worn.

In addition to the previously mentioned advantages, the overall system does not dig into the ground, but rather simply is driven along the surface of the ground to the axis of rotation of the hammer elements 52 does not dig into the ground surface 24 as illustrated in FIG. 1. This is convenient since this "scuffing" or "dragging" would otherwise prematurely wear the hammer elements 52 and thus reduce the overall dimensions thereof. As a natural consequence of this, the distance between wear elements 56 on the anvil and the distance between the hammer elements 52 would therefore be altered fairly quickly prior to a significant pulverization of rock material. In this regard, it has been contemplated that it is useful to maintain the hammer elements at least above the surface of the ground to circumvent this difficulty experienced in the prior art.

Returning briefly to FIG. 1, it has been found that if the internal combustion engine 36 is positioned forwardly of the rotor assembly 50 that the center of mass of the apparatus 10 is altered. By positioning the engine 36 forwardly, a significant amount of the weight is ahead of the assembly 50 and connection sites 40. This is useful when the apparatus is in use; under the extreme pressures, as the rock material is collected and brought into contact with the assembly 50, the significant forces involved cause the elevation of the entire area around the frame means 14 such that the same generally "bounces" or is substantially unstable. By providing the mass at the forward end of the frame 14 with engine 36, the center of mass is effectively moved away from the area where the assembly 50 is located in order to lend stability to the overall apparatus 10. This arrangement effectively damps the motion induced by the pulverizing activity and further, eliminates the complication of having the engine 36 directly over the assembly 50. In this latter arrangement, significant premature damage can occur to assembly 50 since the added weight together with the bouncing effectively bashes the assembly into the ground 24. By moving the engine to the forward position as indicated, such vertical forces are not experienced by assembly 50 thereby enhancing the useable lifespan.

Although embodiments of the invention have been described above, it is not limited thereto and it will be apparent to those skilled in the art that numerous modifications form part of the present invention insofar as they do not depart from the spirit, nature and scope of the claimed and described invention.

I claim:

1. In a rock crushing apparatus having a frame, an anvil mounted therein, means for mounting a rotor means, and a rotor means having hammer elements disposed thereon for cooperation with the anvil, the improvement wherein said rotor means has a longitudinal axis and an outside surface; a plurality of recesses extending parallel to said longitudinal axis in spaced relation about said outside surface; a plurality of rotor protection members for protecting said rotor means, said rotor protection members being releasably mounted in said recesses, said rotor protection members extending outwardly of said outside surface of said rotor means for preventing wear of said outside surface; said hammer elements being releasably mounted in said recesses of said rotor means, said hammer elements alternating with said rotor protection members along said longitudinal axis within said recesses and extending outwardly of said rotor protection members, said hammer elements including means for lifting and pulverizing rock material.

2. The apparatus as set forth in claim 1, wherein each recess of said recesses is continuous.

3. The apparatus as set forth in claim 2, wherein said recesses alternate with said outside surface of said rotor means.

4. The apparatus as set forth in claim 3, wherein said outside surface comprises a plurality of arcuate segments in alternation with said recesses.

5. The apparatus as set forth in claim 4, wherein said arcuate segments extend longitudinally of said rotor.

6. The apparatus as set forth in claim 1, wherein said rotor has a first radius relative to said center of said rotor means, said first radius extending to said outside surface of said rotor means, a second radius relative to said center of said rotor means extending to said rotor protection members, and a third radius relative to said center of said rotor means extending to said hammer elements.

7. The apparatus as set forth in claim 6, wherein said second radius is greater than said first radius.

8. The apparatus as set forth in claim 7, wherein said third radius is greater than said first radius.

9. The apparatus as set forth in claim 1, wherein said rotor means includes opposed ends, each end of said ends having a releasably engagable shaft for rotatable mounting of said rotor means, each said opposed end including a threaded portion and a segment of increasing diameter relative to said threaded portion, each said shaft having a threaded portion and a segment configured to cooperatively and releasably engage each said end of said opposed ends.

10. The apparatus as set forth in claim 9, wherein said shafts are self-retained within said rotor means.

11. The apparatus as set forth in claim 10, wherein said hammer means comprises generally claveat-shaped members.

12. A rock crushing apparatus for crushing rock material, said apparatus having a center of mass, said apparatus comprising:

a rotor means having hammer elements disposed thereon for cooperation with an anvil, the improvement wherein said rotor means has a longitudinal axis and an outside surface; a plurality of recesses extending parallel to said longitudinal axis in spaced relation about said outside surface; a plurality of rotor protection members for protecting said rotor means, said rotor protection members being releasably mounted in said recesses, said rotor protection members extending outwardly of said outside surface of said rotor means for preventing wear of said outside surface; said hammer elements being releasably mounted in said recesses of said rotor means, said hammer elements alternating with said rotor protection members along said longitudinal axis within said recesses and extending outwardly of said rotor protection members, said hammer elements including means for lifting and pulverizing rock material;

a frame means for rotatably and releasably mounting said rotor means;

a means for connection with a vehicle on said frame means; and, independent drive means on said frame means for driving said rotor means, said drive means positioned forwardly of said center of mass of said apparatus for stabilizing said apparatus when in use.

13. The apparatus as set forth in claim 12, wherein said rotor means includes opposed ends for threadably receiving a removable shaft.

14. The apparatus as set forth in claim 13, wherein said removable shaft comprises a stub shaft, each stub shaft being tapered and configured to be threadable within an opposed end of said rotor means.

15. The apparatus as set forth in claim 14, wherein said hammer elements are disposed in a helical pattern along a longitudinal axis of said rotor means.

16. The apparatus as set forth in claim 12, wherein said hammer elements cooperate with said anvil to provide primary pulverization of rock material, said rotor protection members also cooperating with said anvil for secondary pulverization of said rock material.

17. A rock crushing system for crushing rock material, said apparatus including frame means, connection means on said frame means for connecting said frame means to a vehicle; anvil means associated with said frame means;

a rotor means having hammer elements disposed thereon for cooperation with said anvil means, said rotor means having a longitudinal axis and an outside surface;

a plurality of recesses extending parallel to said longitudinal axis in spaced relation about said outside surface;

a plurality of rotor protection members for protecting said rotor, said rotor protection members being releasably mounted in said recesses, said rotor protection members extending outwardly of said outside surface of said rotor means for preventing wear of said outside surface;

said hammer elements being releasably mounted in said recesses of said rotor means, said hammer elements alternating with said rotor protection members along said longitudinal axis within said recesses and extending outwardly of said rotor protection members, said hammer elements including means for lifting and pulverizing rock material against said anvil means;

independent drive means on said frame means for driving said rotor means, said drive means positioned forwardly of said center of mass of said apparatus for stabilizing said apparatus when in use; and, a vehicle for advancing said apparatus.

18. The apparatus as set forth in claim 17, wherein said frame means rotatably and releasably mounts said rotor means.

* * * * *